US008986021B2

(12) United States Patent
Keswani

(10) Patent No.: US 8,986,021 B2
(45) Date of Patent: Mar. 24, 2015

(54) CONNECTOR HAVING A PUSH-IN TERMINATION FOR AN ELECTRICALLY ACTIVE GRID

(71) Applicant: IDEAL Industries, Inc., Sycamore, IL (US)

(72) Inventor: Sushil N. Keswani, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 137 days.

(21) Appl. No.: 13/724,730

(22) Filed: Dec. 21, 2012

(65) Prior Publication Data

US 2013/0237072 A1 Sep. 12, 2013

Related U.S. Application Data

(63) Continuation of application No. 13/416,472, filed on Mar. 9, 2012, now abandoned.

(51) Int. Cl.
*H01R 25/00* (2006.01)
*H01R 25/14* (2006.01)

(52) U.S. Cl.
CPC ..... *H01R 25/145* (2013.01); *H01R 25/142* (2013.01); *H01R 25/147* (2013.01)
USPC ..... 439/110

(58) Field of Classification Search
USPC ..... 439/110, 120–122, 533, 552, 216
See application file for complete search history.

(56) References Cited

U.S. PATENT DOCUMENTS

| | | | | |
|---|---|---|---|---|
| 1,997,716 | A | 4/1935 | Brooks et al. | |
| 3,725,568 | A * | 4/1973 | Stanley | 174/491 |
| 4,540,847 | A * | 9/1985 | Gardner | 174/491 |
| 5,653,609 | A | 8/1997 | Orstad et al. | |
| 6,722,918 | B2 * | 4/2004 | McCoy | 439/533 |
| 7,374,057 | B2 * | 5/2008 | Hendrickson et al. | 220/3.8 |
| 7,661,229 | B2 * | 2/2010 | Frecska et al. | 52/220.6 |
| 7,997,910 | B2 * | 8/2011 | Myers et al. | 439/121 |
| 8,062,042 | B2 | 11/2011 | Patterson et al. | |
| 8,338,719 | B2 * | 12/2012 | Lehane et al. | 174/480 |
| 2004/0082866 | A1 | 4/2004 | Mott et al. | |
| 2005/0169015 | A1 | 8/2005 | Luk et al. | |
| 2007/0153550 | A1 * | 7/2007 | Lehman et al. | 362/648 |
| 2009/0017694 | A1 | 1/2009 | Bethurum et al. | |

OTHER PUBLICATIONS

ISA/US, Int. Search Report and Written Opinion issued on PCT Appln. No. US2013/029910, received May 28, 2013, 16 pgs.

* cited by examiner

*Primary Examiner* — Jean F Duverne
(74) *Attorney, Agent, or Firm* — Greenberg Traurig, LLP

(57) ABSTRACT

An example electrical connector includes a non-electrically-conductive housing carrying at least a pair of opposed flexible, electrically-conductive push-in type contacts. The contacts each having a first end configured to receive and grip an electrical conductor, and a second end having a contact portion to releasable electrically couple with a corresponding conductive strip housed on opposite sides of an upper rail of a corresponding low voltage direct current grid member. In one example, a strain relief mechanism is coupled to the housing and is adapted to mechanically couple to the inserted electrical conductor and to assist in retaining the inserted electrical conductor in the push-in type contact. The housing may also define at least a pair of first interior spaces enclosing the first end of each of the contacts and for receiving and gripping the electrical conductor.

14 Claims, 6 Drawing Sheets

CONNECTOR HAVING A PUSH-IN TERMINATION FOR AN ELECTRICALLY ACTIVE GRID

FIELD OF THE DISCLOSURE

The present description relates generally to electrical connectors and more particularly to a connector having a push-in termination for an electrically active grid.

BACKGROUND OF RELATED ART

Connectors and more particularly, connectors for making low voltage direct current electrical connection between conductive elements are known in the art. In particular, in one known application of a low voltage DC system, an electrified framework brings power and/or signals to an electrically powered device connected to the framework through specialized connectors.

For example, U.S. Pat. No. 7,997,910, hereby incorporated by reference in its entirety, describes an electrified framework system having a grid element which includes a top portion having a pair of conductors for distributing low voltage electricity disposed thereon. The conductors have opposing polarity and are disposed on opposing surfaces of the top portion of the grid element. The prior system also includes a connector which is mounted on the top portion of the grid element. The connector includes two conductive wire crimp contacts to provide a low voltage power connection between the pair of conductors and another conductive element capable of distributing low voltage electricity.

Meanwhile, U.S. Pat. No. 8,062,042, hereby incorporated by reference in its entirety, similarly describes an electrified framework for bringing low voltage direct current power to various connected devices. In this described example, the framework includes an electrified bus bar such as those commonly used in suspended ceiling systems utilizing lay-in panels. The example bus includes a pair of conductors disposed on opposing surfaces of the top portion of the bus, and a pair of longitudinally extending electrifiable conductors positioned inside a lower flange portion of the bus to form an internal bus bar. In the described example, an electrical connector straddles over top of the support grid member and includes a conductive material extending downwardly from the top portion o f the grid member until a second exposed portion can mate with the lower conductor through a predefined access slot.

The connector of U.S. Pat. No. 7,997,910 utilizes a wire crimp (e.g., a spring) to hold a wire in the connector housing. The spring does the work of holding the wire in the connector, and yet is subject to misalignment and disconnection due to movement and/or strain on the wire. Because the grid is typically utilized in confined spaces, the wire problems with the prior art are oftentimes exaggerated.

The connector of U.S. Pat. No. 8,062,042, meanwhile provides for a clamping type connection between the upper and lower conductors of the grid itself The example connector does not provide for an interface between the grid and an external electrical device.

Accordingly, there is an identifiable need for a connector that is adapted for use with a low-voltage DC power grid including an electrified grid framework. The disclosed example connector provides for a push-in type contact for securely accepting multiple conductor sizes, and/or a conductor types. The disclosed connector that provides for the proper seating of an inserted wire within the housing of the connector, as well as a strain relief to hold the wire securely within the connector.

DETAILED DESCRIPTION

The following description of example electrical connectors is not intended to limit the scope of the description to the precise forms detailed herein. Instead the following description is intended to be illustrative so that others may follow its teachings.

Figure 1:
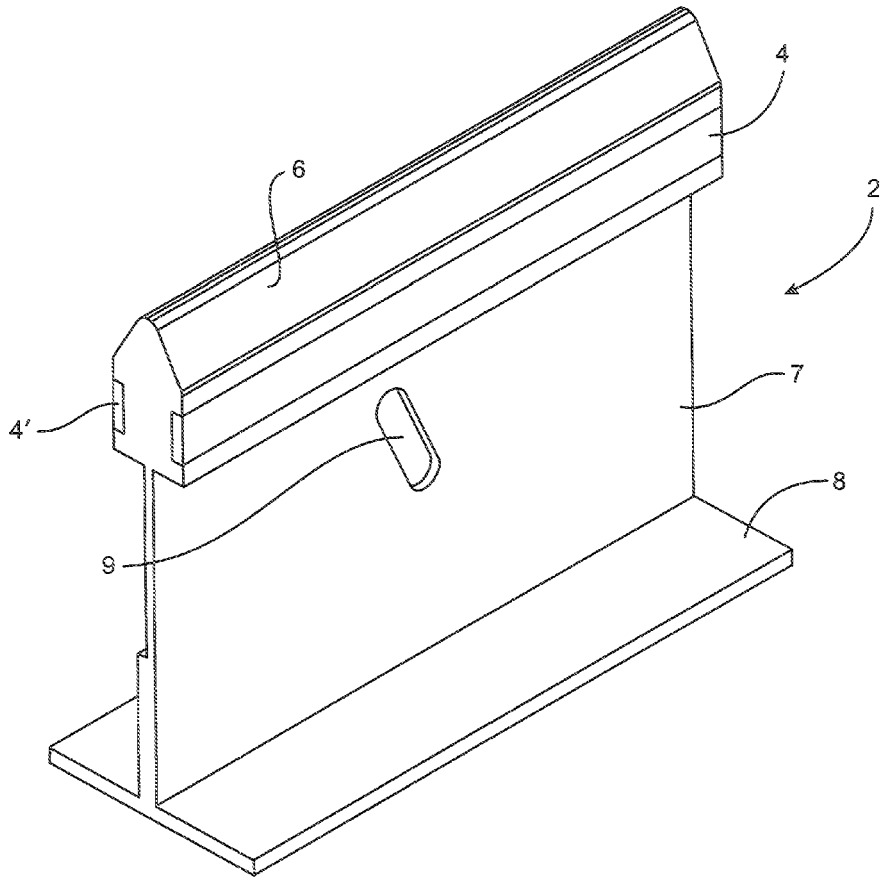
FIG. 1 PRIOR ART
FIG. 1 is a perspective view of a section of a prior art grid member for use with an example connector in accordance with the present disclosure.
Figure 2:
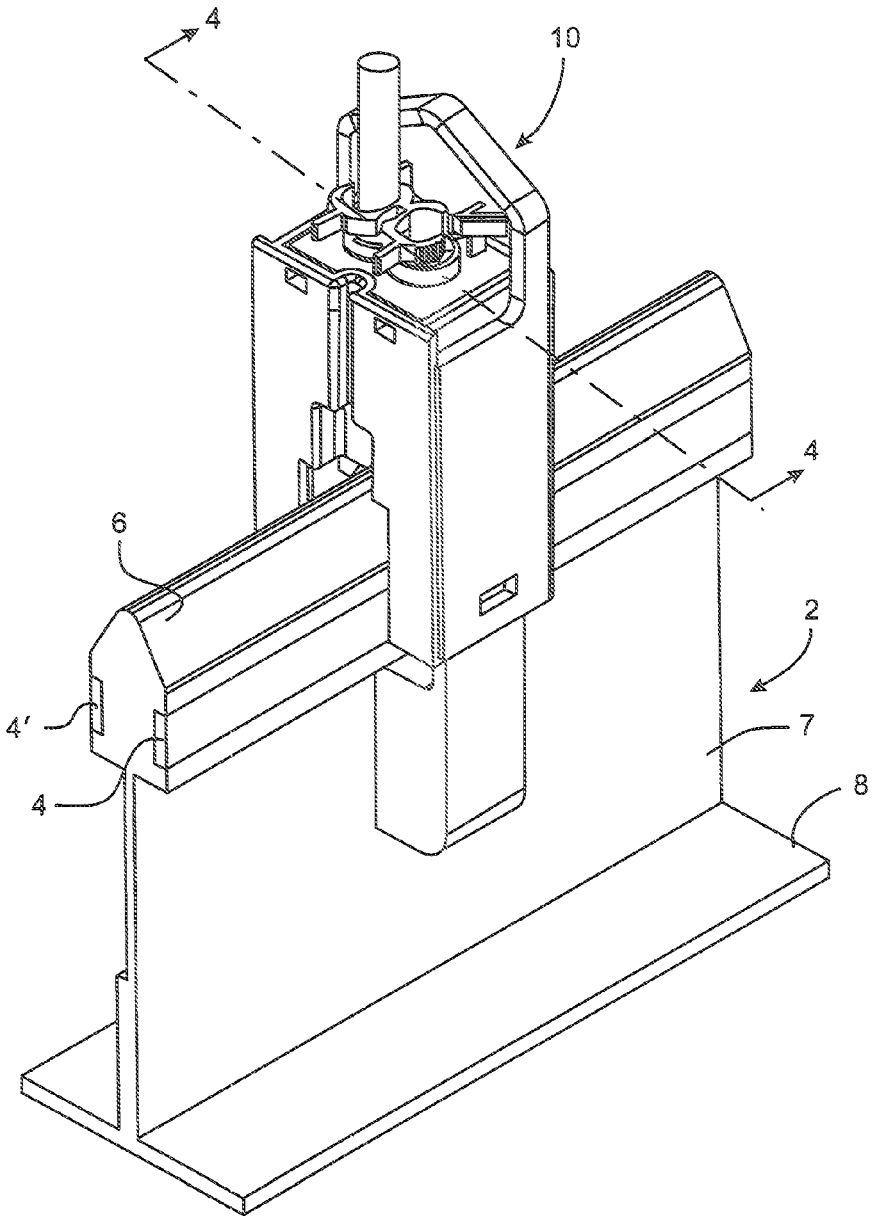
FIG. 2 is a perspective view of an example connector of the present disclosure attached to the grid member of FIG. 1.

Referring now to FIG. 1, an example of a prior art grid member 2 for forming an electrified framework, such as a ceiling grid framework, is shown. The grid member 2 may be utilized in any system having a grid framework, including floors and wall. The grid member 2 is adapted to support decorative tiles, acoustical tiles, insulative tiles, lights, heating ventilation and air conditioning (HVAC) vents, other ceiling elements or covers and combinations thereof. Low voltage devices, such as light emitting diode (LED) lights, speakers, smoke or carbon monoxide detectors, wireless access points, still or video cameras, or other low voltage devices, may utilize the electrified ceiling for power and/or signal connectivity.

In the example grid member 2, a conductive material is disposed on a surface of the grid member. Specifically, first and second conductive strips 4 and 4' are disposed on the grid element 2, and specifically, a top portion 6, e.g. bulb portion thereof. The conductive strips 4, 4' have opposite polarity, i.e. one is positive and one is negative. The grid member 2 includes a vertical web 7 extending between the top portion 6 and a lower portion 8, such as a flange for supporting the tiles. The web 7 includes a plurality of keying slots 9, which is angled, or sloping, and which is precisely positioned in the vertical web of the grid member at a pre-determined location.

One or more connectors is needed to provide low voltage power connections. For example, a connector is needed to bring power from a power supply to the conductive strips 4, 4' disposed on the grid member 2. Additionally, a connector is needed to provide an electrical connection between the conductive strips 4, 4' on the grid member 2 and a device such as a light. The example connector described in greater detail below may provide is capable of supplying the power necessary.

Specifically, referring to FIGS. 2-6, an example connector 10 is illustrated as electrically and mechanically mated to the grid member 2. The connector 10 provides a means for bringing power, or electricity, from a power supply to the conductive strips 4 and 4' disposed on the grid member 2 or, in the alternative, from the already electrified conductive strip 4 and 4' to various low voltage devices.

Figure 3:
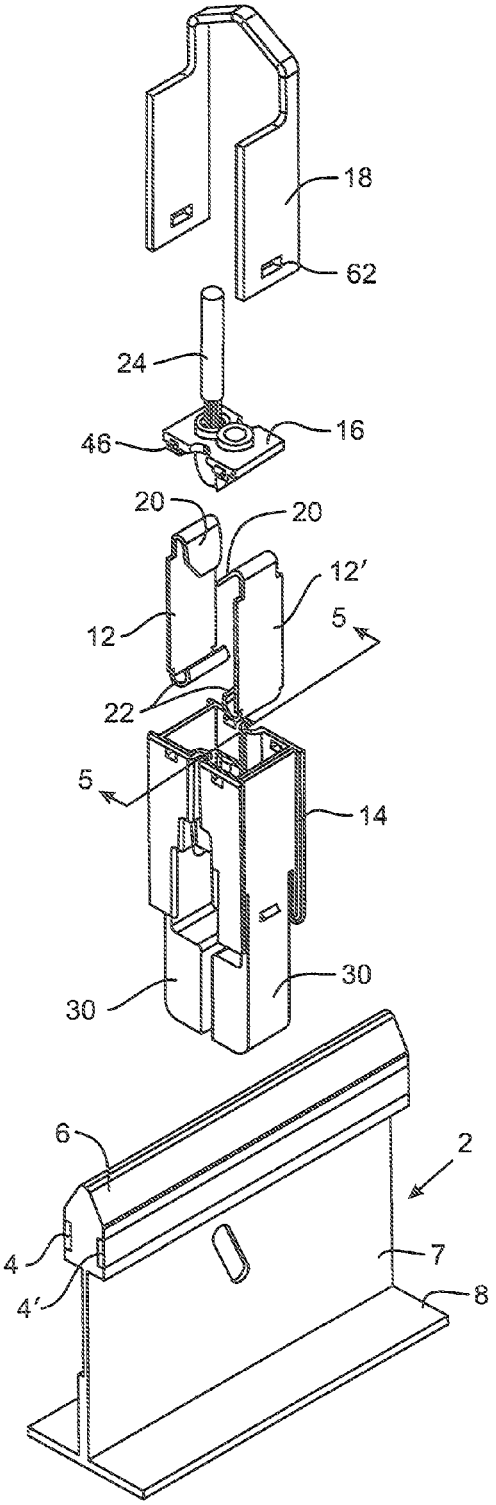
FIG. 3 is an exploded perspective view of the example connector of FIG. 2.
Figure 4:
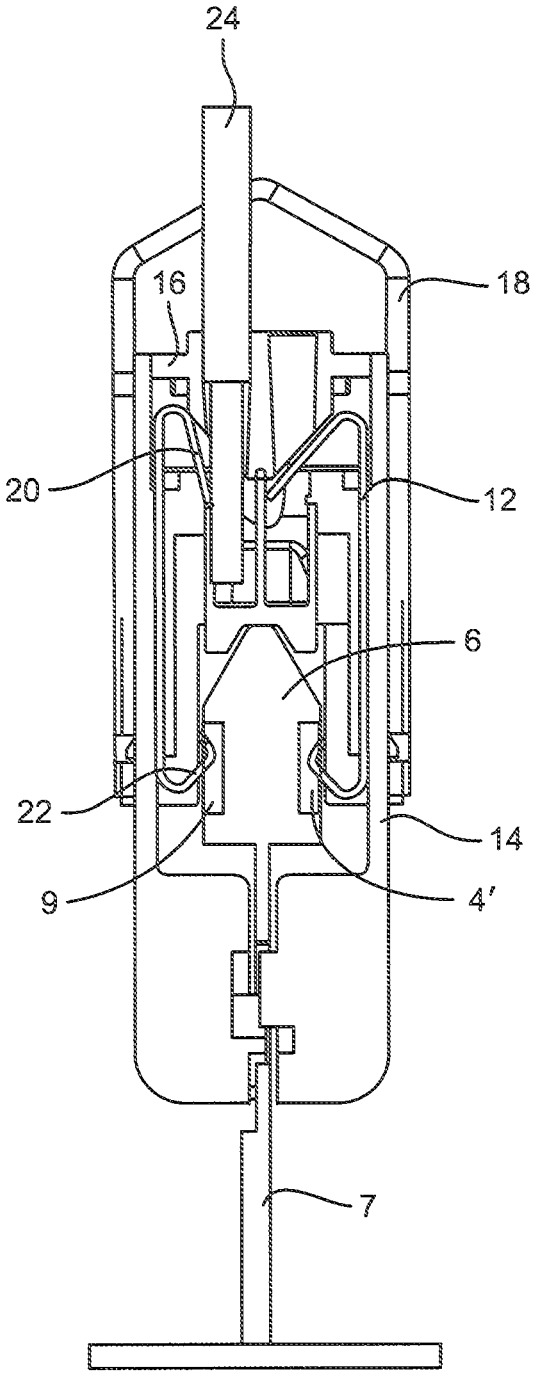
FIG. 4 is a right side cross-sectional view of the example connector of the present disclosure taken along line 4-4 of FIG. 2.

As best seen in FIGS. 3 and 4, the example connector 10 includes two conductive, push-in type, electrical contacts 12 and 12', a nonconductive, insulative housing 14, a cap 16, and an outer clamp 18. Each electrical contact 12, 12' includes a first contact potion 20 and a second contacting portion 22. The first contacting portion 20 of the contact 12, 12' includes a resilient portion, such as for example, a spring finger for contacting, retaining, and electrically coupling with a wire 24 inserted through the cap 16. The second contacting portion 22 of the contact 12, 12' also includes a resilient portion such as a contact spring, which is compliant and upon installation is brought in contact with, i.e. taps, the conductive strips 4, 4' disposed on the top portion 6 of the grid member 2. Upon installation, together, the grid member 2 and the housing 14 enclose the second contacting portion 22 of each of the contacts 12, 12'.

In at least one example, the housing 14 and the cap 16 are formed of a non-conductive material such as, for example, a thermoplastic material. The housing 14 and/or the cap 16 may further be formed of a flexible material to allow the insertion of the cap 16 into the housing 14, as will be described below, the insertion of the housing 14 over the grid member 2. It will be appreciated by one of ordinary skill in the art, however, that the material used to form the housing 14 and the cap 16 need not be the same material, and furthermore, may be any suitable material including thermoplastic, thermoset, conductive, and non-conductive materials alike.

Figure 5:
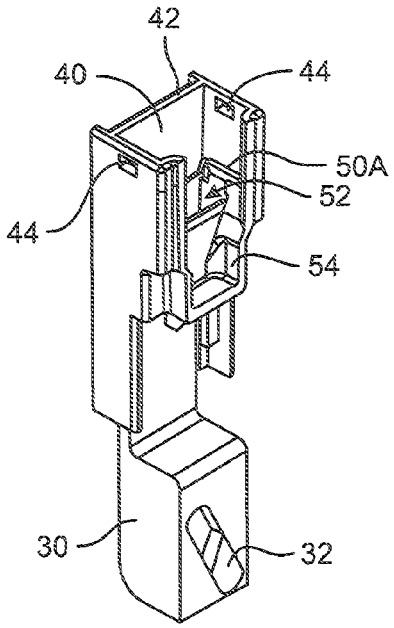
FIG. 5 is a perspective cross-sectional view of the housing of the example connector of the present disclosure taken along line 5-5 of FIG. 3.

In this example, the connector 10 comprises an optional location/polarization feature. In particular, this feature is designed to assure that the connector 10 can only be installed and fully engaged at pre-determined locations on the grid member 2. More specifically, the polarization feature, an example of which is shown in FIG. 5 is a pair of molded, flexible wings 30 extending from the lower portion of the housing 14. The wings 30 are sufficiently thin and/or flexible such that during installation, the wings 30 can separate such that the housing 14, and thus the connector 10 can be inserted over the top portion 6 of the grid member 2. A protrusion 32 on each wing 30 engages and passes through the keying slot 9, which is angled, or sloping, and positioned in the vertical web 7 of the grid member 2 at pre-determined locations. Only when this protrusion 32 of the wing 30 is in proper alignment and seated in the sloping keying slot 9, will the outer clamp 18 be capable of being fully seated on the connector housing 14.

Figure 6:
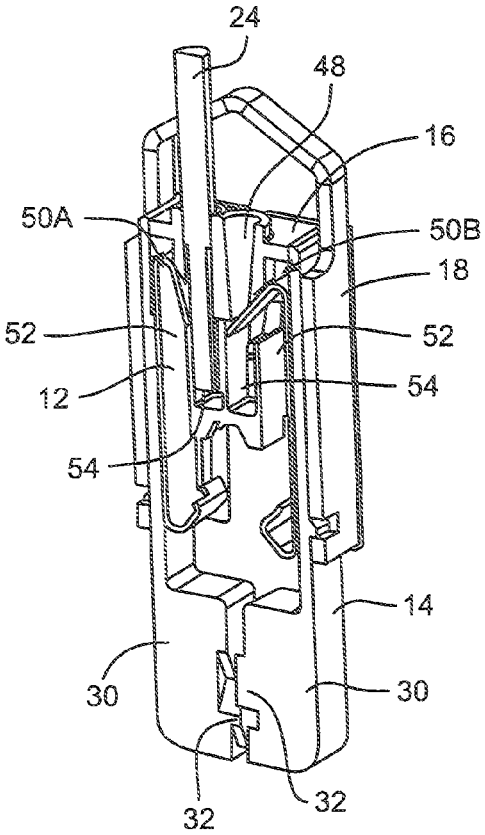
FIG. 6 is a perspective cross-sectional view of the example connector of the present disclosure taken along line 4-4 of FIG. 2 with the grid member removed.
Figure 7:
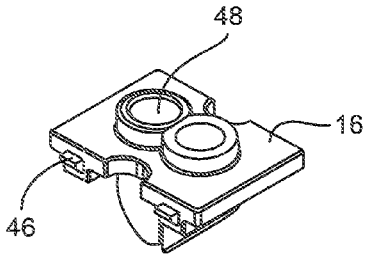
FIG. 7 is a perspective view of the cap of the example connector of the present disclosure.
Figure 8:
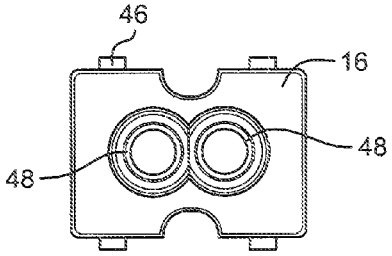
FIG. 8 is a top plan view of the example cap of FIG. 7.

Referring to FIGS. 5 and 6, together, the housing 14 and the cap 16 partially enclose the two contacts 12, 12' mounted in an interior space 40 defined by an upper portion of the housing 14. The interior space 40 includes an open end 42 to receive the cap 16. The housing 14 defines at least one aperture 44 proximate to the open end 42 of the interior space 20. The aperture 44 is adapted to engage a corresponding hook 46 (see FIGS. 7, 8) which protrudes from the cap 16 to retain the cap 16 in the housing 14. Additionally, the example cap 16 has a pair of ports 48 extending through the cap 16. These ports 48 provide access to, and guide the insertion of the wire 24 into the interior space 40 of the housing.

Still further, in the illustrated example, each of the hooks 46 includes a cammed surface and a stepped surface to securely engage the hooks 46 in a corresponding aperture 44 in a snap-fit arrangement. As will be appreciate by one of ordinary skill in the art, in the example shown, the proper seating of each of the hooks 46 in the proper aperture 44 will provide an externally visible confirmation of the proper seating of the cap 16 within the housing 14. For instance, if the cap 16 is not properly seated, the cammed surface will force the housing 14 defining the opening 40 outwards from the cap 16, providing a visual and physical indication that the cap 16 is improperly seated in the housing 14. In still other examples, the hook 46 may be provided with a color indicator and/or other visual marker to identify when the cap 16 is properly retained in the housing 14.

FIGS. 5-6 also illustrate the interior features of the housing 14. In the illustrated example of FIG. 5 both the contacts 12, 12' and the cap 16 typically located within the housing 14 have been removed for ease of illustration, while in FIG. 6, the entire connector as assembled is illustrated in cross-section. In this example, the housing 14 generally defines two contact and wire receiving compartments 50A and 50B. Each of the compartments 50A, 50B includes an contact compartment 52 and a wire receiving compartment 54. The contact compartment 52 is adapted to partially accept the contact 12, 12' and more specifically, the second contact portion 22. The wire receiving compartment 54, meanwhile is generally a four-sided compartment sized to retain the first contact portion 20 and to accept the wire 24, such as an 14 awg stranded wire, inserted through the ports 48 formed in the cap 16. It will be understood by one of ordinary skill in the art that the ports 48 and the compartments 50A, 50B may be sized to accept any size and/or type of suitable contact and/or wire such as larger/smaller contacts and wires of larger and/or smaller gauge as well as stranded and/or solid wires. As illustrated in FIG. 5, the walls of the wire receiving compartments 54 may be tapered in cross section to pinch and/or otherwise constrict the wire 24 when inserted into the housing 14.

In the illustrated example, dividing the contact compartment 52 and the wire receiving compartment 54 is a spring stop 60. The spring stop prevents over-deflection of the first contact portion 20 and also cooperates with the walls of the wire receiving compartment 54 to properly seat the inserted wire 24 in the wire receiving compartment 54. In operation, the wire receiving compartment 54 also constrains the wire 24 to a confined area which may be of particular importance for some conductors, such as for example, with stranded wire conductors because the confined seats prevent the conductors from flattening out or splaying, which if it occurred could cause a reduction in the holding force of the push-in type contact elements 12, 12'. As noted, the spring stop 60 may also limit deflection of the spring finger of the contact elements 24. With the larger wire sizes it may be possible to cause plastic deformation of the first contact portion 20 during insertion of the wire 24, and thus the spring stop 60 is disposed in the path of the first contact portion 20 to limit flexure of the first contact portion 20 to an amount no more than its elastic limit.

The outer clamp 18 can be used to secure the housing 14 on the grid member 2. The example clamp 18 is made of rigid, yet somewhat resilient material, and snaps over the housing 14. Although the clamp can be installed, or even pre-assembled, on the housing prior to attaching the connector to the grid element, the clamp can be installed in at least two other ways to minimize insertion forces. First, the clamp can be installed after fully seating the housing on the grid element to provide for low insertion forces. Alternatively, the clamp can be partially installed on the housing in an up position and then fully seated after the housing is in the fully mated position which also provides low insertion forces but require the clamp to be pre-assembled on the housing. In one example, the clamp 18 includes at least one aperture 62 adapted to engage a corresponding hook 64 which protrudes from the housing 14 to retain the clamp 18 on the housing 14 when the clamp is fully installed.

Figure 9:
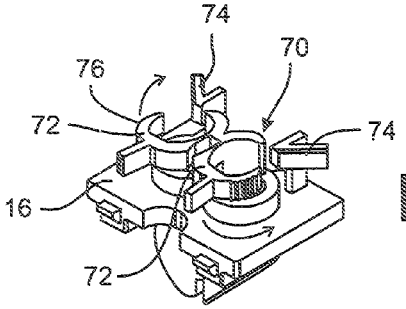
FIG. 9 is a perspective view of the example cap of FIG. 7 showing an example strain relief mechanism in an open position.
Figure 10:
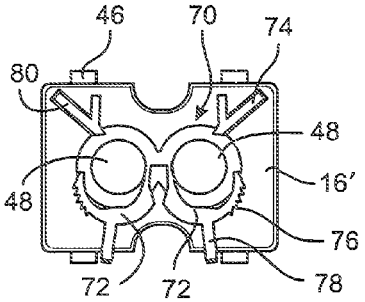
FIG. 10 is a top plan view of the example clip of FIG. 9.
Figure 11:
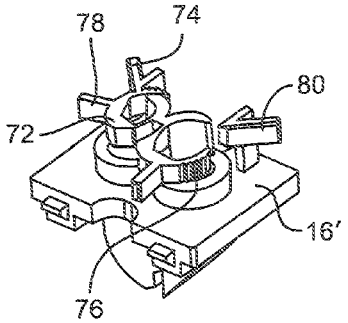
FIG. 11 is a perspective view of the example cap of FIG, 9 showing the example strain relief mechanism in a closed position.

In one example, illustrated in FIGS. 9 and 10 an alternative cap 16' having means for relieving strain on the wire 24 may be utilized in place of the cap 16. In this example, the cap 16' is identical to the cap 16 but includes an addition of a strain relief mechanism 70. In the illustrated example, the strain relief mechanism 70 is a ratchet-type retainer adaptable to mate with wires of various sizes. For instance, in this example, the strain relief mechanism 70 includes a rotatable arcuate portion 72 and a stationary ratchet 74. The rotatable arcuate portion 72 includes a plurality of ratchet teeth 76 to contact and releasable engage the ratchet 74 when the rotatable portion 72 is rotated towards the ratchet 72. In this example, the rotatable portion 72 is provided with a handle 78 to assist in the rotation of the rotatable portion 72 towards the ratchet 72.

As will be appreciated, the ratchet 74 may include a release mechanism 80 that when depressed, provide a deflection of the ratchet 72 sufficient to allow the arcuate portion 74 to rotate away from the ratchet 72. It will further be appreciated that in operation, the strain relief mechanism 70 is closed about the wire 24 to grip the outer surface of the wire 24 and provide a sufficient strain relief to avoid the unintended release of the wire 24 from the housing 14. Additionally, it will be understood by one of ordinary skill in the art that while the strain relief mechanism 70 is described as a ratchet-type mechanism in the present disclosure, strain relief may be provided by any suitable mechanism including, for example, a spring, a clip, an overmould, a bushing, and/or any other suitable mechanism.

Still further it will be appreciated that while the example connector 10 is described as containing a pair of connectors maintaining a single wire in each contact, it will be appreciated that in some instances, their may be multiple connectors marinating multiple wires as desired. For example, in some instances, multiple wires may be inserted into a single finger.

Furthermore, it will be understood that throughout this description, relative designations such as "top", "bottom", "front", "rear", "down", "up", etc, are used herein for reference purposes only, as there is nothing inherent in the orientation of the example disconnects that would make a particular orientation necessary.

Although certain examples have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. An electrical connector for use with a low voltage, direct current grid member having a first side carrying a first conductive strip and a second side opposed to the first side carrying a second conductive strip, the electrical connector comprising:

a non-electrically-conductive housing having a first contact compartment, a second contact compartment, a first wire receiving compartment positioned adjacent to the first contact compartment, and a second wire receiving compartment positioned adjacent to the second contact compartment;

a first flexible, electrically-conductive push-in type contact disposed in the first contact compartment; and a second flexible, electrically-conductive push-in type contact disposed in the second contact compartment;

wherein the first push-in type contact has a first end and a second end, wherein the first end of the first push-in type contact has a first contact portion which extends from the first contact compartment into the first wire receiving compartment and which is arranged to be cooperable with a first wall of the first wire receiving compartment to grip therebetween a first electrical conductor when inserted into the first wire receiving compartment, and wherein the second end of the first push-in type contact has a second contact portion which is positioned relative to the housing to electrically couple with the first conductive strip when the housing is releasably positioned upon the low voltage direct current grid member; and wherein the second push-in type contact has a first end and a second end, wherein the first end of the second push-in type contact has a first contact portion which extends from the second contact compartment into the second wire receiving compartment and which is arranged to be cooperable with a first wall of the second wire receiving compartment to grip therebetween a second electrical conductor when inserted into the second wire receiving compartment, and wherein the second end of the second push-in type contact has a second contact portion which is positioned relative to the housing to electrically couple with the second conductive strip when the housing is releasably installed upon the low voltage direct current grid member.

2. An electrical connector as defined in claim 1, wherein the housing has first and second opposed side walls and wherein the first and second side walls of the housing cooperate with the low voltage direct current grid member to enclose the second end of each of the first and second push-in type contacts when the housing is releasably installed upon the low voltage direct current grid member.

3. An electrical connector as defined in claim 1, wherein the housing has a first aperture for directing the first conductor into the first wire receiving compartment and a second aperture for directing the second conductor into the second wire receiving compartment and wherein the housing further comprises a first conductor strain relief mechanism positioned adjacent to the first aperture and a second conductor strain relief mechanism positioned adjacent to the second aperture.

4. An electrical connector as defined in claim 3, wherein the housing, the first conductor strain relief mechanism, and the second conductor strain relief mechanism are integrally formed.

5. An electrical connector as defined in claim 3, wherein the first conductor strain relief mechanism and the second conductor strain relief mechanism each comprises an arcuate portion having ratchet teeth disposed thereon and a stationary ratchet configured to contact the ratchet teeth and retain the arcuate portion when the arcuate portion is moved towards the stationary ratchet.

6. An electrical connector as defined in claim 1, further comprising a cap for enclosing the first contact compartment, the second contact compartment, the first wire receiving compartment, and the second wire receiving compartment and for retaining the first and second push-in type contacts within the housing.

7. An electrical connector as defined in claim 6, wherein the cap has a first aperture for directing the first conductor into the first wire receiving compartment and a second aperture for directing the second conductor into the second wire receiving compartment and wherein the cap further comprises a first conductor strain relief mechanism positioned adjacent to the first aperture and a second conductor strain relief mechanism positioned adjacent to the second aperture.

8. An electrical connector as defined in claim 7, wherein the cap, the first conductor strain relief mechanism, and the second conductor strain relief mechanism are integrally formed.

9. An electrical connector as defined in claim 7, wherein the first conductor strain relief mechanism and the second conductor strain relief mechanism each comprises an arcuate portion having ratchet teeth disposed thereon and a stationary ratchet configured to contact the ratchet teeth and retain the arcuate portion when the arcuate portion is moved towards the stationary ratchet.

10. An electrical connector as defined in claim 1, wherein the housing further comprises a pair of flexible wings extending from the housing, wherein the wings are arranged to be disposed on the opposite sides of the low voltage direct current grid member below the conductive strips when the housing is releasably installed upon the low voltage direct current grid member.

11. An electrical connector as defined in claim 10, further comprising a protrusion on at least one the wings, the protrusions adapted to engage and pass through a keying slot provided to the low voltage direct current grid member.

12. An electrical connector as recited in claim 1, wherein the first wire receiving compartment is positioned adjacent to the second wire receiving compartment.

13. An electrical connector as recited in claim 12, further comprising a clamp element cooperable with the housing to maintain the housing installed upon the low voltage direct current grid member.

14. An electrical connector as recited in claim 10, wherein at least one of the wings is separately attachable to the housing.

* * * * *